United States Patent [19]

Kartinen

[11] 4,010,891

[45] Mar. 8, 1977

[54] VAPOR REMOVAL APPARATUS FOR OIL/WATER SEPARATOR

[75] Inventor: Ernest O. Kartinen, Long Beach, Calif.

[73] Assignee: Burmah Oil & Gas Company, Long Beach, Calif.

[22] Filed: Jan. 8, 1976

[21] Appl. No.: 647,472

[52] U.S. Cl. ..... 233/3; 233/33; 233/34

[51] Int. Cl.[2] ..... B04B 11/02

[58] Field of Search ..... 233/1 R, 3, 7, 27, 28, 233/34, 45, 32, 33, 22, 19 R, 19 A

[56] References Cited

UNITED STATES PATENTS

| | | | |
|---|---|---|---|
| 791,496 | 6/1905 | Ponten | 233/3 |
| 2,630,268 | 3/1953 | Abbott | 233/19 R |
| 2,767,841 | 10/1956 | Cram | 233/32 X |
| 3,791,575 | 2/1974 | Kartinen et al. | 233/19 A |
| 3,931,927 | 1/1976 | Hengstebeck | 233/19 R |

*Primary Examiner*—George H. Krizmanich
*Attorney, Agent, or Firm*—Knobbe, Martens, Olson, Hubbard & Bear

[57] ABSTRACT

Apparatus for permitting a direct flow of vapor entrained in incoming oil/water streams to a centrifugal oil/water separator device into the oil collection chamber of such a device to inhibit the accumulation of such vapor within the input impeller chamber of such a centrifugal separator and to thereby assure proper operation of said impeller and the prohibition of cavitation which would otherwise generate a serious pressure drop within the separator.

4 Claims, 6 Drawing Figures

VAPOR REMOVAL APPARATUS FOR OIL/WATER SEPARATOR

BACKGROUND OF THE INVENTION

This invention relates to centrifugal oil/water separators designed for removing relatively small amounts of oil from large water streams. More specifically, this application pertains to a device for removing vapor entrained in the inlet water flow to avoid cavitation within such a separator device.

My prior U.S. Pat. Nos. 3,791,575 and 3,890,347 best describe the state of the art in devices designed for separating relatively small amounts of oil from relatively larger amounts of water. Such fluid streams may be found, for example, in the ballast tanks of oceangoing vessels or in other systems wherein large volumes of waste water must be disposed of without the danger to the environment which would occur if small amounts of oil were allowed to be disposed of along with the water. The first of my prior patents, U.S. Pat. No. 3,791,575, is directed to the basic concept of controlling the oil/-water interface within a centrifugal separator by comparing the pressure at the emulsion input to the pressure at the oil outlet. The second Pat. No. 3,810,347 is directed toward an arrangement for removing entrained vapors from a foamy input emulsion, the vapor removed as a separate by-product from the separator. While the latter patent provides for the centrifugal separation of vapors from the liquid input element, it does not adequately provide for the removal of bubbles which enter the centrifugal separator to form a vapor pocket at the input impeller of the separator. Such vapor pockets generally do not occur as a consequence of the foamy emulsion described in U.S. Pat. No. 3,810,347 but rather occur as a consequence of vapor bubbles in an otherwise liquid stream. The bubbles are therefore transferred separately in the inlet stream to the separator and are easily separated from the remaining stream flow prior to the centrifugal action of the separator. For this reason, such bubbles can accumulate at the separator input in the input impeller chamber and, if allowed to accumulate to a sufficient extent, can create cavitation in the input impeller. Since this input impeller is necessary for maintaining pressure balance within the separator system, that is, for reducing pressure loss through the system, it is imperative that such cavitation be prohibited. In prior art systems wherein no mechanism was included for the removal of such vapor accumulations, it has been found necessary to periodically stop the separator to purge the inlet channel and to then reactivate the system for a period of time until subsequent vapor accumulations exist.

SUMMARY OF THE INVENTION

This vapor accumulation problem is alleviated through the use of the present invention which permits a direct flow of vapor from the inlet conduit to the oil chamber within the separator so that such air bubbles may flow along with the collected oil out of the separator through the oil discharge pipe. Since, contrary to the basic operation of the device described in U.S. Pat. No. 3,810,347, there is no desire in the present instance to separately collect the vapor as a by-product of centrifugation, the vapor is allowed to flow as a waste by-product with the oil from the separator.

The separator of the present invention is identical in construction to the separator of my previous U.S. Pat.

No. 3,791,575 and reference is made thereto for a complete understanding of the basic operation of the separator. Briefly, this separator includes a rotating cylindrical drum including plural internal baffle plates for increasing the gravitational forces on the emulsion to be separated and thereby generating an inner cylindrical mass of oil which directly interfaces with an outer tubular mass of water, these masses flowing through separate outlet tubes from the separator. At the inlet of the separator, plural impeller blades are mounted between a first end of the cylindrical separator and a first circular baffle plate to provide a pressure increase for balancing the pressure produced by the rapid rotation of fluid within the separator. A similar plurality of impeller blades exists at the opposite end of the separator, positioned between the remaining end of the cylindrical separator and a second circular plate, for drawing exhaust clean water from the outer perimeter of the separator for flow into an exhaust water conduit. It has been found that the input impeller which is used for balancing pressure forces within the separator is subject to cavitation due to the collection of vapor bubbles within the impeller chamber defined by the end wall of the separator and the first circular plate. These bubbles are not pumped by the impeller into the main separator chamber since they tend to float within the rapidly rotating mechanism at the center line of the mechanism. The vapor accumulation thus grows from a position adjacent the center line of the rotating separator outward, encompassing a larger and larger portion of the impeller chamber until the impeller, which is effective in increasing the pressure of liquids but not of vapors, becomes virtually ineffective in balancing the flow of fluid into the separator.

This problem is overcome in the present invention by providing a direct flow for vapor from the input conduit of the separator system upstream of the input impeller to the center of the main separator chamber, that is, the portion of the separator chamber which houses the rotating cylindrical oil mass. Two separate techniques are disclosed in this application for providing this flow. The first technique employs plural small apertures which provide communication between the inlet conduit and the main separator chamber, these apertures being either plural drilled holes of very small diameter which provide a relatively low flow impedance to vapor and a relatively high flow impedance to the liquid, or the use of a glass or metal frit having a relatively fine pore size which permits the low impedance flow of vapor and a relatively high impedance flow channel for liquids. Through the use of this first embodiment, the flow of air from the inlet conduit to the oil portion of the main separator chamber is permitted while a direct flow of the input emulsion into the oil portion of the separator is impeded.

In a second embodiment of the present invention a simple valving system is provided at the interface between the oil/water emulsion input and the oil portion of the main separator chamber, this valving system permitting the direct flow of vapor between the inlet channel and the main separator chamber but prohibiting the flow of input oil/water emulsion therethrough.

The present invention therefore assures that a vapor pocket cannot accumulate in the input impeller to such a separator while providing an impediment to flow of water/oil emulsion into the main separator channel when no such vapor pocket exists.

The present invention is best understood through the following detailed description which references the drawings, in which.

DETAILED DESCRIPTION OF THE PREFERRED EMBODIMENT

Figure 1:
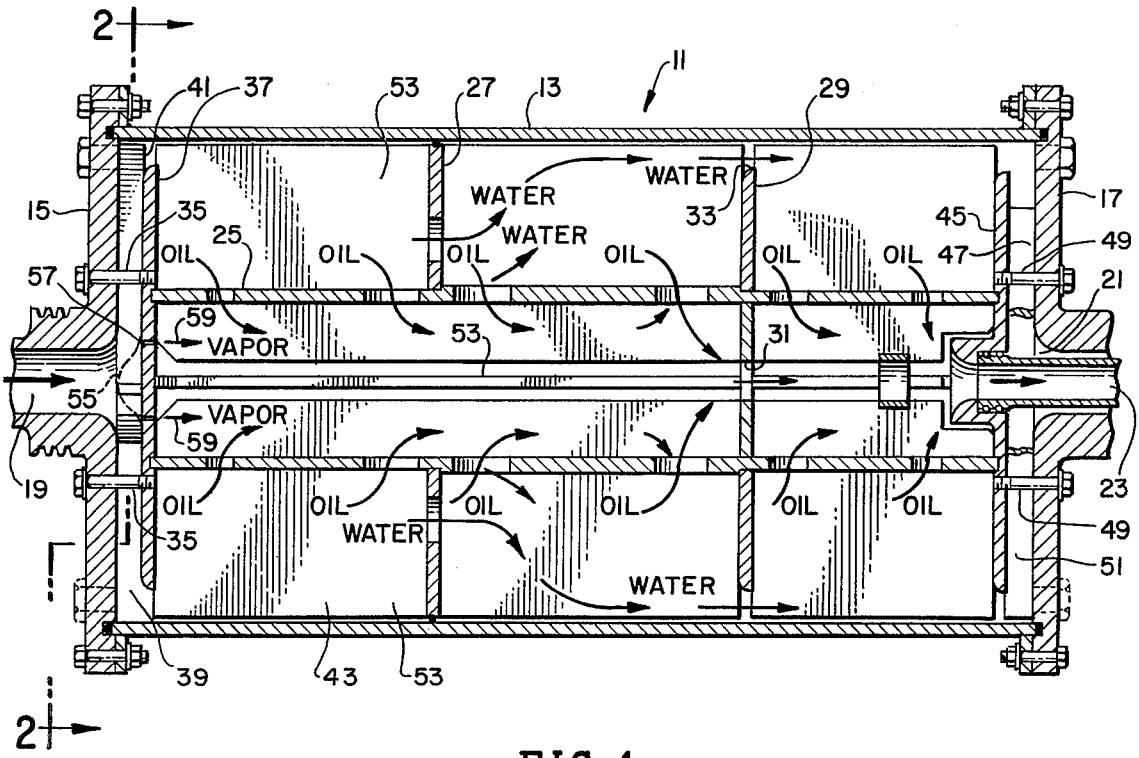
FIG. 1 is a sectional view taken longitudinally through the center of the oil/water separator of the present invention.
Figure 2:
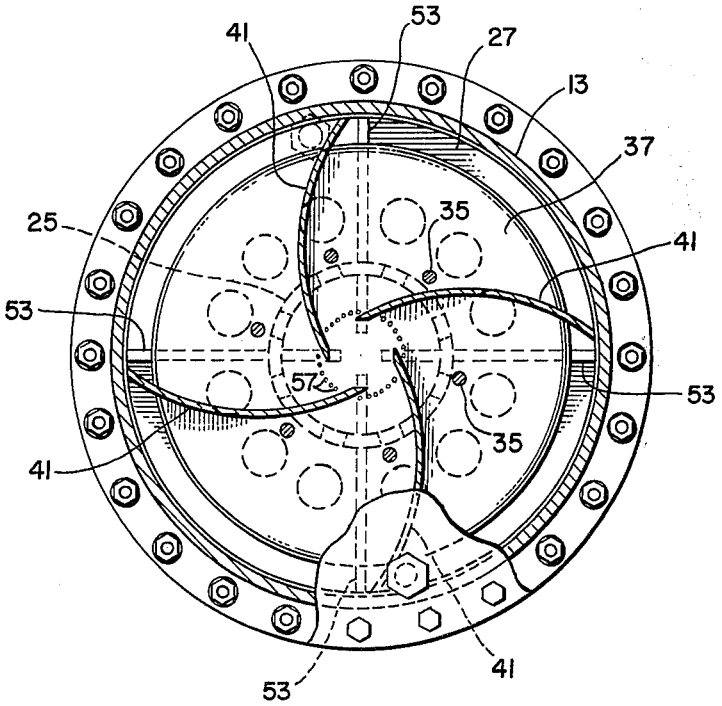
FIG. 2 is a sectional view taken along lines 2—2 of FIG. 1.
Figure 3:
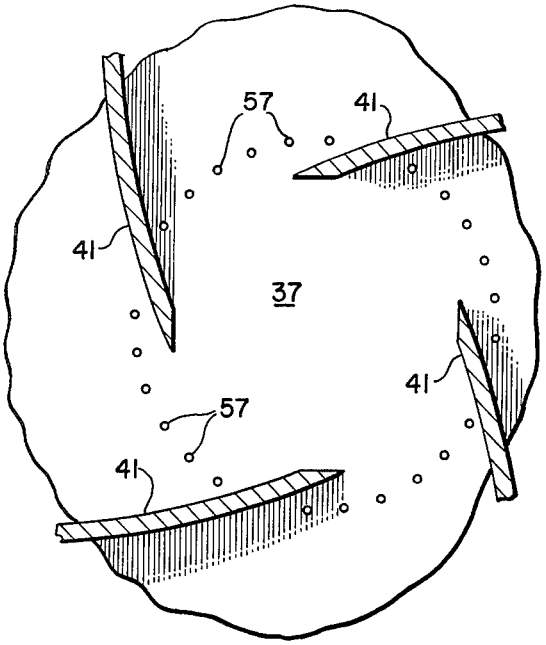
FIG. 3 is an enlarged partial sectional view taken along lines 2—2 of FIG. 1 but showing only the center portion of FIG. 2.

Referring initially to FIGS. 1 through 3, the invention is incorporated within a centrifugal oil/water separation device 11 which is described in detail in my previous U.S. Pat. Nos. 3,791,575 and 3,810,347, the description in those patents being incorporated herein by reference. Briefly, the separator 11 includes a main cylindrical drum 13 closed by a pair of circular end plates 15 and 17, the end plate 15 providing a centrally located intake conduit 19. The end wall 17 provides a water outlet conduit 21 which is centrally located on the end 17 as well as an oil outlet conduit 23 which is mounted coaxially with the conduit 21. It will be understood that the entire apparatus, including the cylindrical drum 13 and end plates 15 and 17, along with the remaining internal elements described below, are rotated at a high rate of revolution to provide a radial gravity vector within the drum 13, the gravity vector being sufficient to cause a gravitational separation of oil and water admitted through the inlet conduit 19.

As described in my previous patents, it has been found advantageous to locate coaxially within the drum 13 a perforated cylindrical drum 25 and to mount thereon plural baffle plates 27 and 29 which are generally flat circular plates mounted parallel to the end plates 15 and 17. The baffle plate 27 may conveniently be perforated and sealed both to the drum 13 and the perforated drum 25, whereas the baffle plate 29 conveniently extends between a relatively small central opening 31 and an outer circumference 33 spaced from the cylindrical drum 13 to provide a weir over which water passes to aid in fluid separation. Plural arrows shown in FIG. 1 and identified by the titles "oil" and "water" indicate generally the direction of flow of these fluids within the rotated system, the water being forced toward the outer perimeter of the rotating drum 13 while the oil is forced toward the center of the rotating drum 13, resulting in a water/oil interface which is cylindrical in shape and is maintained preferably just inside of the perforated drum 25.

Rigidly mounted, as by a pair of bolts 35, to the end wall 15 is an impeller supporting plate 37 generally circular in shape and positioned parallel to the end wall 15 to provide an impeller cavity 39 in which plural impeller blades 41 are located. These impeller blades 41 extend from a position adjacent the center of the plate 37 to a position adjacent the drum 43 and, when rotated with the entire structure 11, provide an impelling force for driving fluid entering the system through the inlet conduit 19 past the outer circumference of the plate 37 and into the main separator cavity 43. A similar second impeller mounting plate 45 supports impeller fins 47 and is attached to the second end plate 17 by plural screws 49. This second impeller 47, mounted within a second impeller cavity 51, serves to draw separated water from the main separator chamber 43 for flow through the water exhaust conduit 21. As is apparent from FIG. 1, the bolt 35 and 49 serve to support the inner perforated cylinder 25 along with the baffle plates 27 and 29. In addition, plural radially and longitudinally extending plates 53 extend from positions adjacent the outer cylindrical drum 13 to locations slightly spaced from the central axis of the cylinder 13 to separate the main separator cavity 43 into four longitudinally extending segments. These plates 53 are rigidly attached to the perforated drum 25 and baffle plates 27 and 29, as well as the impeller supporting plates 37 and 45 to assure that the entire mass of fluid within the main separator cavity 43 is rotated as the separator 11 rotates.

Referring specifically to FIG. 1, a vapor pocket 55 results during operation of the separator 11 if vapor bubbles are present in the input stream in the conduit 19. Such vapor bubbles are forced against the impeller supporting plate 37 and, due to the radial gravity vector existing within the rotating separator 11, these vapor bubbles tend to float on the fluid within the input impeller chamber 39 along the axis of the separator 11. As additional vapor bubbles are fed to the separator 11, and specifically the impeller chamber 39, the vapor pocket 55 will tend to expand radially within the chamber 39, encompassing increasing areas of that chamber and rendering larger portions of the impeller veins 41 ineffective. It will be understood that these veins 41 are capable of generating a pressure increase which is sufficient to balance the increased pressure generated by the radial gravitational vector within the rotating separator 11 if fluid exists within the chamber 39. If the chamber 39 is partially filled with air, however, the veins 41 generate a reduced pressure differential and the pressure in the input conduit 19 may ultimately become ineffective for pumping fluid into the system. Thus, the pressure drop through the system is substantially increased and the flow rate through the system is drastically reduced. As mentioned previously, it has been necessary, in order to overcome this difficulty in prior systems, to discontinue the rotation of the separator 11. When this was accomplished, the vapor accumulation 55 was permitted to float within the chamber 39 to the upper wall of the outer cylinder 13 so that, when the system was again rotated, this vapor accumulation was pumped by the fluid flow within the main cavity 14 toward the impeller chamber 51, floating at the axis of the rotating system 11, for exhaust through the oil exit conduit 23. Such required intermittent operation of the device reduced the system efficiency substantially.

The first embodiment of the present invention, as best shown in FIGS. 1, 2 and 3, provides plural relatively small apertures 57 drilled in a circular pattern about the axis of the separator 11 through the impeller support plate 37. The apertures 57 are preferably of small enough diameter to present a substantial flow impedance to liquids but large enough to present a relatively small impedance to vapor flow. Thus, the accumulated vapor concentration 55 is permitted to flow directly through the impeller support plate 37 from the impeller housing 39 to the main separator cavity 43, and typically into the center of the separator cavity 43 at a location within the oil/water cylindrical interface, such that the vapor flows directly into the pure oil cylindrical mass at the center of the separator 11. The vapor within the main separator cavity 43, due to the radial gravitational vector, will tend to accumulate along the axis of the separator 11 and, due to the fluid flow at the axis, will flow out the oil exhaust conduit 23 to be discharged with the oil. In operation, therefore, the accumulated vapor pocket 55 will be maintained at a size approximately equal to that shown in FIG. 1. Thus, as the outer radial extremities of the vapor pocket 55 extend beyond the orifices 57, the vapor will pass, as shown by the arrows 59, into the main separator chamber 43. As the vapor pocket 55 is reduced, its circular perimeter will decrease to a position within the orifices 57, and flow of input liquid from the conduit 19 will be impeded by the high liquid flow impedance of the orifices 57. By way of example, the orifices 57 may have a diameter of 0.0325 inches, and the thickness of the impeller mounting plate 37 may be 0.25 inches. Since, as explained above, the outer circumference of the accumulated vapor pocket 55 will be maintained at approximately the same diameter as the position of the orifices 57, it is preferable that the orifices 57 be maintained as close to the axis of the separator 11 as possible to reduce the size of the vapor pocket 55.

Figure 4:
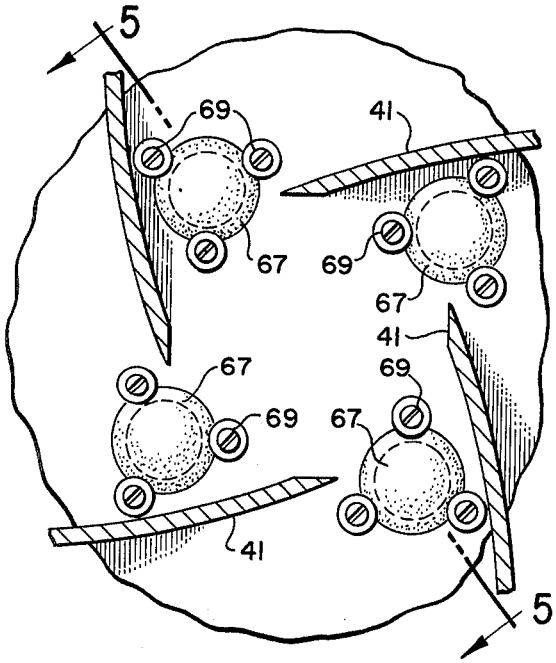
FIG. 4 is a partial sectional view similar to the view of FIG. 3 but showing a first alternate embodiment of the present invention.
Figure 5:
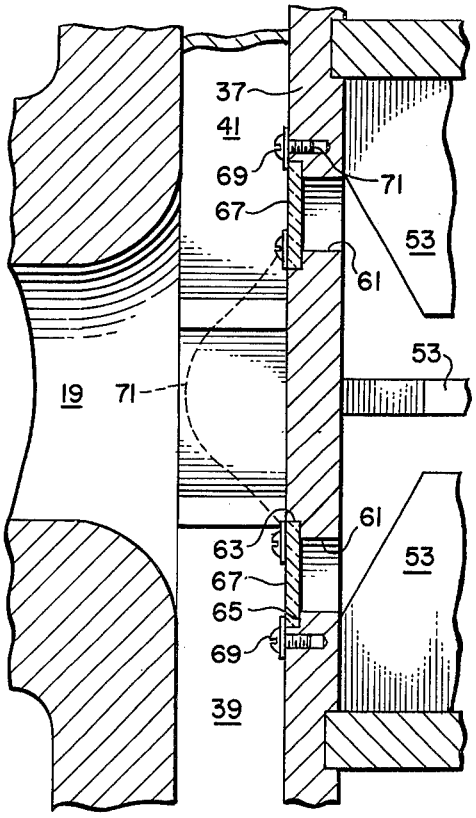
FIG. 5 is a partial sectional view identical to the sectional view of FIG. 1 but showing only the center portion adjacent the inlet conduit of the embodiment shown in FIG. 4.

A first alternate embodiment of the present invention is shown in FIGS. 4 and 5. It will be understood that FIG. 4 is similar to FIG. 3 and that FIG. 5 is a greatly enlarged sectional diagram of the impeller mounting plate 37 and inlet conduit 19 adjacent the axis of the separator 11. In this embodiment, the plural orifices 57 are replaced by plural larger orifices 61 having an increased diameter portion 63 providing a shoulder 65 facing the inlet conduit 19. Positioned and sealed against the shoulder 65 of each of the apertures 61 is a relatively flat circular frit 67 formed, for example, of glass or metal shaving material which is compressed to the circular flat shape shown and heated sufficiently to melt the shaving edges together to form a unitarily bonded porous mass having a pore size depending upon the degree of compression applied to the shaving material. The pore size of the frit 67 may therefore be maintained at any desired size, and is preferably reduced sufficiently to provide a very high flow impedance to liquids while providing a relatively low flow impedance to vapors. These frits 67 may be attached to the shoulders 65 by any convenient means, the embodiment shown utilizing plural circumferentially spaced screws 69 threaded into plural bores 71 within the impeller mounting plate 37 to rigidly attach the frit 67 to the impeller mounting plate 37. It will be seen that the operation of the embodiment of FIGS. 4 and 5 essentially identical to that of FIGS. 1 through 3, a vapor pocket 71 diagrammed in FIG. 5 being confined along the axis of the separator 11 by the radial gravitational vector and confined against the impeller mounting plate 37 by the input flow of fluid in the inlet conduit 19. When the outer circumference of the vapor pocket 71 extends across the frits 67, the vapor is permitted to flow directly into the main separator chamber 43, and specifically the oil-containing portion thereof. when the vapor pocket 71 is reduced in volume, its circumference lies within the location of the frits 67, and the frits 67 provide a relatively high impedance to the input liquid emulsion within the inlet conduit 19, so that the flow of this emulsion into the oil-containing portion of the main separator chamber 43 is minimal.

Figure 6:
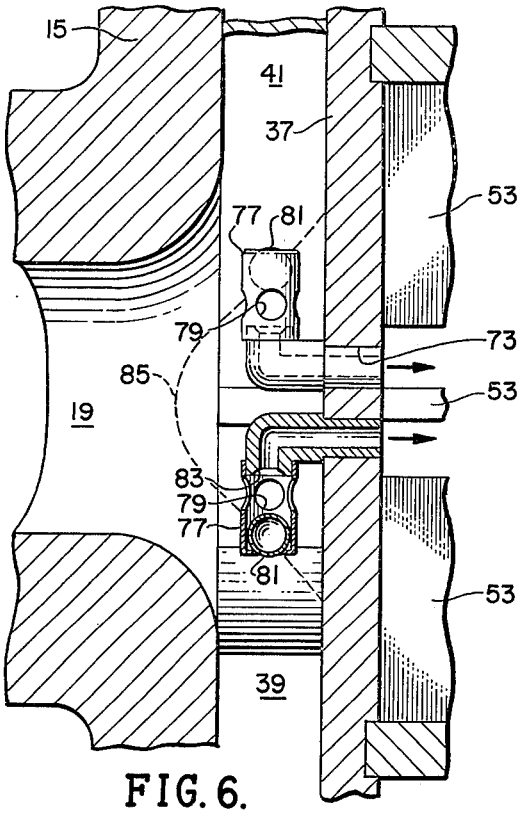
FIG. 6 is a sectional view similar to the view of FIG. 5 showing a second alternate embodiment of the present invention.

Referring now to FIG. 6, a third embodiment of the present invention is shown in a diagram which is similar to the sectional view of FIG. 5. In this embodiment, plural apertures 73 through the impeller mounting plate 37 are positioned adjacent the axis of the separator 11. Mounted within each of these apertures 73 is a tubular fitting 75 which typically extends a short distance away from the impeller mounting plate 37 toward the inlet conduit 19. At that point, the fitting 75 makes a right angle bend to face radially outward from the axis of the separator 11. The fittings 75 are each provided with a cage member 77 which includes plural apertures 79 and houses a buoyant spherical valve member 81. The end of the fittings 75 are preferably chamfered, as shown at 83, to provide a sealing seat for the ball 81. As has been mentioned previously, the gravitational vector within the impeller chamber 39 is radial, such that, in the presence of a vapor/emulsion interface, the buoyant valve member 81 will tend to float on this interface and move radially within the chamber 39 as the interface changes. A vapor accumulation pocket 85 thus supports the buoyant valve members 81 so that, as this pocket 85 is reduced in size, the buoyant valve members 81 will move radially to close the valve seats 83 and fittings 75, prohibiting the passage of emulsion from the inlet conduit 19 directly to the main separator cavity 43. As vapor accumulates in the pocket 85, however, the emulsion/vapor interface will grow radially, permitting the buoyant valve members 81 to float away from the valve seats 83 and permitting the vapor to flow through the orifices 79 and fittings 75 to the oil accumulation portion of the main separator cavity 43. As with the prior embodiments, it is helpful to maintain the position of the valve seats 83 as close to the axis of the separator 11 as possible to reduce the permitted volume of the vapor accumulation pocket 85 to the greatest extent possible.

What is claimed is:

1. A centrifugal oil/water separator comprising:

an inlet conduit for supplying a mixture of oil and water to said separator, said mixture including vapor bubbles;

a main, rotating centrifugal separator chamber;

an impeller chamber fluidly connected between said inlet conduit and said main separation chamber;

an impeller mounted within said impeller chamber;

means comprising plural apertures through said separator plate for permitting flow of said vapor bubbles directly from said inlet conduit to said main chamber at a location adjacent the rotational axis of said chamber; and plural frits mounted in said plural apertures for generating different flow impedances for vapor and liquid flows through said aperture.

2. A centrifugal oil/water separator comprising:

an inlet conduit for supplying a mixture of oil and water to said separator, said mixture including vapor bubbles;

a main, rotating centrifugal separator chamber;

an impeller chamber fluidly connected between said inlet conduit and said main separation chamber;

an impeller mounted within said impeller chamber; and means for permitting flow of said vapor bubbles directly from said inlet conduit in said main chamber at a location adjacent the rotational axis of said main chamber, wherein said means for permitting flow of said vapor bubbles comprises valve means for selectively permitting flow of said vapor bubbles while prohibiting flow of said oil/water mixture.

3. A centrifugal oil/water separator comprising:

an inlet conduit for supplying a mixture of oil and water to said separator, said mixture including vapor bubbles;

a main, rotating centrifugal separator chamber;

an impeller chamber fluidly connected between said inlet conduit and said main separation chamber;

an impeller mounted within said impeller chamber; and means for permitting flow of said vapor bubbles directly from said inlet conduit to said main chamber at a location adjacent the rotational axis of said main chamber, wherein said means for permitting said flow of said vapor bubbles presents a relatively low flow impedance to said vapor bubbles and a relatively high flow impedance to said mixture of oil and water.

4. A centrifugal oil/water separator comprising:

an inlet conduit for supplying an oil/water emulsion with entrained vapor to said separator;

a rotating main separator cavity for separating said emulsion into an oil mass located adjacent the axis of rotation of said main cavity and a water mass spaced from said rotation axis by said oil mass;

means for conducting liquid flow from said inlet conduit directly into said water mass within said main cavity; and means for conducting vapor flow from said inlet conduit directly into said oil mass within said main cavity wherein said means for conducting vapor flow presents a relatively low impedance to vapor flow and a relatively high impedance to liquid flow.

* * * * *